US005283097A

United States Patent [19]

Gillyns et al.

[11] Patent Number: 5,283,097

[45] Date of Patent: Feb. 1, 1994

[54] PROCESS FOR MAKING MOLDABLE, TUFTED POLYOLEFIN CARPET

[75] Inventors: Emile M. Gillyns, Sandweiler, Luxembourg; Didier R. Stochmel, Aumetz, France; Ewald A. Ebers, Hambourgerstrasse, Fed. Rep. of Germany

[73] Assignee: E. I. Du Pont de Nemours and Company, Wilmington, Del.

[21] Appl. No.: 995,516

[22] Filed: Dec. 21, 1992

Related U.S. Application Data

[62] Division of Ser. No. 816,402, Dec. 31, 1991.

[51] Int. Cl.[5] ..... B32B 1/00; B32B 5/04; B32B 5/12; D04H 11/00

[52] U.S. Cl. ..... 428/91; 428/95; 428/96; 428/97; 428/107; 428/109; 428/174; 428/287; 428/294; 428/295; 428/300

[58] Field of Search ..... 428/91, 95, 96, 97, 428/107, 109, 174, 286, 287, 300

[56] References Cited

U.S. PATENT DOCUMENTS

| | | | |
|---|---|---|---|
| 3,163,753 | 12/1964 | DiSabato et al. . | |
| 3,192,560 | 7/1965 | Huffman . | |
| 3,313,002 | 4/1967 | Wyeth . | |
| 3,369,547 | 2/1968 | Sack et al. | 128/296 |
| 3,390,035 | 6/1968 | Sands | 156/72 |
| 3,546,062 | 12/1970 | Herrmann . | |
| 3,563,838 | 2/1971 | Edwards . | |
| 3,692,622 | 9/1972 | Dunning . | |
| 3,821,062 | 6/1974 | Henderson . | |
| 3,855,046 | 12/1974 | Hansen et al. . | |
| 3,940,525 | 2/1976 | Ballard | 428/96 |
| 4,086,381 | 4/1978 | Chesire et al. | 428/113 |
| 4,230,755 | 10/1980 | Morris | 428/95 |
| 4,232,434 | 11/1980 | Pfister | 26/86 |
| 4,508,771 | 4/1985 | Peoples, Jr. et al. | 428/95 |
| 4,568,581 | 2/1986 | Peoples, Jr. | 428/35 |
| 4,582,750 | 4/1986 | Lou et al. | 428/288 |
| 4,842,915 | 6/1989 | Hartmann et al. | 428/95 |
| 4,935,295 | 6/1990 | Serafini | 428/286 |

FOREIGN PATENT DOCUMENTS

| | | |
|---|---|---|
| 1132120 | 10/1968 | United Kingdom . |
| 2085938 | 5/1982 | United Kingdom . |

OTHER PUBLICATIONS

Du Pont "Typar" Spunbonded Polypropylene for Primary Carpet Backing article. Bulletin 5-6 (Jul. 1970).

Shealy, O. L. & Lauterbach, H. G., "Spunbonded Polypropylene Carpet Backing", vol. 39-No. 3 (Mar. 1969).

Du Pont "Typar" Spunbonded Polypropylene for Primary Backing in Scatter Rugs article. Bulletin S-11 (Jan. 1774).

*Primary Examiner*—James C. Cannon

[57] ABSTRACT

A nonwoven polyolefin sheet useful as a primary carpet backing in making a moldable, tufted automotive carpet. The polyolefin sheet, preferably polypropylene, is prepared by melt spinning filaments from a plurality of spinnerets and then drawing the spun filaments to a draw ratio of less than 2.0 to maintain high filament elongation as the filaments move from high to low elongation as the draw increases. The drawn filaments are deposited in both the machine and cross-machine directions on a moving collection belt to form a nonwoven sheet having a unit weight of 100 to 150 g/m$^2$. The resulting sheet is lightly bonded using a steam bonder and then debonded such that sheet thickness increases by between 2.5 and 3.5 times. The tufted sheet has an elongation of at least 40%. The invention sacrifices high sheet strength for tufted sheet elongation in both the machine and cross-machine directions in order to make a moldable, tufted automotive carpet that resists tearing, creasing and grinning while still retaining its shape after demolding.

11 Claims, 3 Drawing Sheets

PROCESS FOR MAKING MOLDABLE, TUFTED POLYOLEFIN CARPET

This is a division of application Ser. No. 07/816,402, filed 31 Dec. 1991.

FIELD OF THE INVENTION

The present invention relates to a process for making a nonwoven polyolefin sheet which is useful as a primary carpet backing in moldable carpets. More particularly, the invention relates to a process for making a polypropylene primary carpet backing useful in moldable, tufted automotive carpets.

BACKGROUND OF THE INVENTION

Presently, most automotive carpets are manufactured using a polyester primary carpet backing. Polyester primary carpet backings have sufficiently high elongation and more plastic than elastic behavior. This type of behavior sustains stretching during carpet molding without tearing and allows the backing to remain dimensionally stable after demolding. The high glass transition temperature for polyester (about 80 degrees C. for polyethylene terephthalate (PET)) means that polyester fibers made therefrom will be dimensionally stable following the molding operation. As a result, after a molded carpet is made from a polyester primary carpet backing, the carpet will retain its shape with little tendency to shrink. In the past, polyester primary carpet backings have been the product of choice in the automotive industry due to their moldability and dimensional stability.

Polyolefin fibers, especially polypropylene fibers, are used in making primary backings for broadloom carpets. Polyolefins are less expensive than polyesters. In addition, polyolefins are easier to recycle than polyesters, due to their lower melting point, permitting melting, filtration and re-extrusion at temperatures which generally do not lead to polymer degradation. With increased emphasis on using recyclable materials, and the need to use the lowest priced materials available, it would be very desirable to be able to utilize polyolefin carpets in the automotive industry.

The polypropylene carpet backings used in broadloom carpets do not have sufficient elongation to be molded into shapes suitable for automotive carpets. Typically, the backing will tear during the molding operation. If the draw ratio of the polypropylene fibers is increased in order to increase the strength, the elongation goes down. The higher drawing process also gives higher crystallinity, exacerbating instability problems (tendency of the backing to grow or shrink) due to the lower glass transition point of polypropylene (0 degrees C.). Even if one were able to mold a polypropylene carpet backing without tearing, the molded product will tend to curl and/or lose its shape immediately or shortly after demolding due to the elastic nature of the polypropylene fibers. As a result, in the past it has been considered impossible to a make a satisfactory molded carpet using a polypropylene carpet backing.

From environmental and cost standpoints, however, a molded carpet of 100% polyolefin, especially polypropylene, is extremely desirable. Thus, there has been a long felt need to manufacture moldable, automotive carpets that are fabricated from polyolefin primary carpet backings.

U.S. Pat. No. 3,563,838 (Edwards) discloses a process for making continuous filament nonwoven fabrics. The fabrics are particularly useful as primary backings for tufted carpets since they have exceptionally high resistance to width loss on stretching and high tear strength. However, the primary carpet backings disclosed by Edwards are for use in broadloom carpets and are not directed towards making moldable carpets, such as those necessary for automotive applications.

Clearly, what is needed is a process for making a nonwoven polyolefin sheet which is useful as a primary carpet backing in moldable carpets. The process and resulting nonwoven sheet should not have, or should minimize, the deficiencies inherent in the prior art. Other objects and advantages of the present invention will become apparent to those skilled in the art upon reference to the attached drawings and to the detailed description of the invention which hereinafter follows.

SUMMARY OF THE INVENTION

In accordance with the invention, there is provided a process for making a nonwoven polyolefin sheet useful as a primary carpet backing in moldable carpets. The process comprises, as a first step, melt spinning a bundle of polyolefin filaments from a plurality of spinnerets. Thereafter, the spun filaments are drawn at a draw ratio of less than 2.0 and deposited onto a moving collection device in both the machine and cross-machine directions to form a nonwoven sheet having a unit weight of 100 to 150 g/m$^2$. The nonwoven sheet is thereafter lightly bonded to be sufficiently debondable and then preferably heat stabilized by heating the lightly bonded nonwoven sheet at a temperature and for a period of time sufficient to relax the sheet in both the machine and cross-machine directions. Following bonding, or optionally after heat stabilization, the nonwoven sheet is debonded such that the elongation of the debonded sheet is increased to at least 40%, preferably 50 to 100%, in both the machine and cross-machine directions. Preferably, debonding is performed by tufting the nonwoven sheet with tufting yarns or by needle punching the sheet with smooth needles.

In a preferred embodiment, the process further comprises the steps of applying a locking agent to the debonded sheet to lock the tufting yarns into the debonded sheet. Thereafter, a backcoat is applied to the debonded sheet to provide rigidity to the sheet. Thereafter, a secondary backing, preferably comprising a bonded polyolefin nonwoven sheet, is laminated to the backcoated side of the debonded sheet to form a carpet. Lastly, the resulting carpet is molded into a desired shape.

The invention also comprises debonded, nonwoven polyolefin sheets made by the inventive process. The debonded, nonwoven polyolefin sheet comprises substantially continuous filaments of a polyolefin of 5 to 30 dtex having a unit weight of 100 to 150 g/m$^2$. The debonded, nonwoven sheet has a directional arrangement of filaments in both a machine direction and a cross-machine direction. The debonded, nonwoven polyolefin sheet has a strip tensile strength of at least 10 kg in both the machine and cross-machine directions and an elongation of at least 40% in both the machine and cross-machine directions (i.e., the length and width dimensions of the sheet). Preferably, the polyolefin is isotactic polypropylene.

Molded carpets made by the inventive process find particular usefulness in automotive applications. It is contemplated that such carpets could be used to cover the area above a car's floor boards or to cover the trunk area of the car.

BRIEF DESCRIPTION OF THE DRAWINGS

The invention will be better understood with reference to the following figures.

DETAILED DESCRIPTION OF THE PREFERRED EMBODIMENTS

Figure 1:
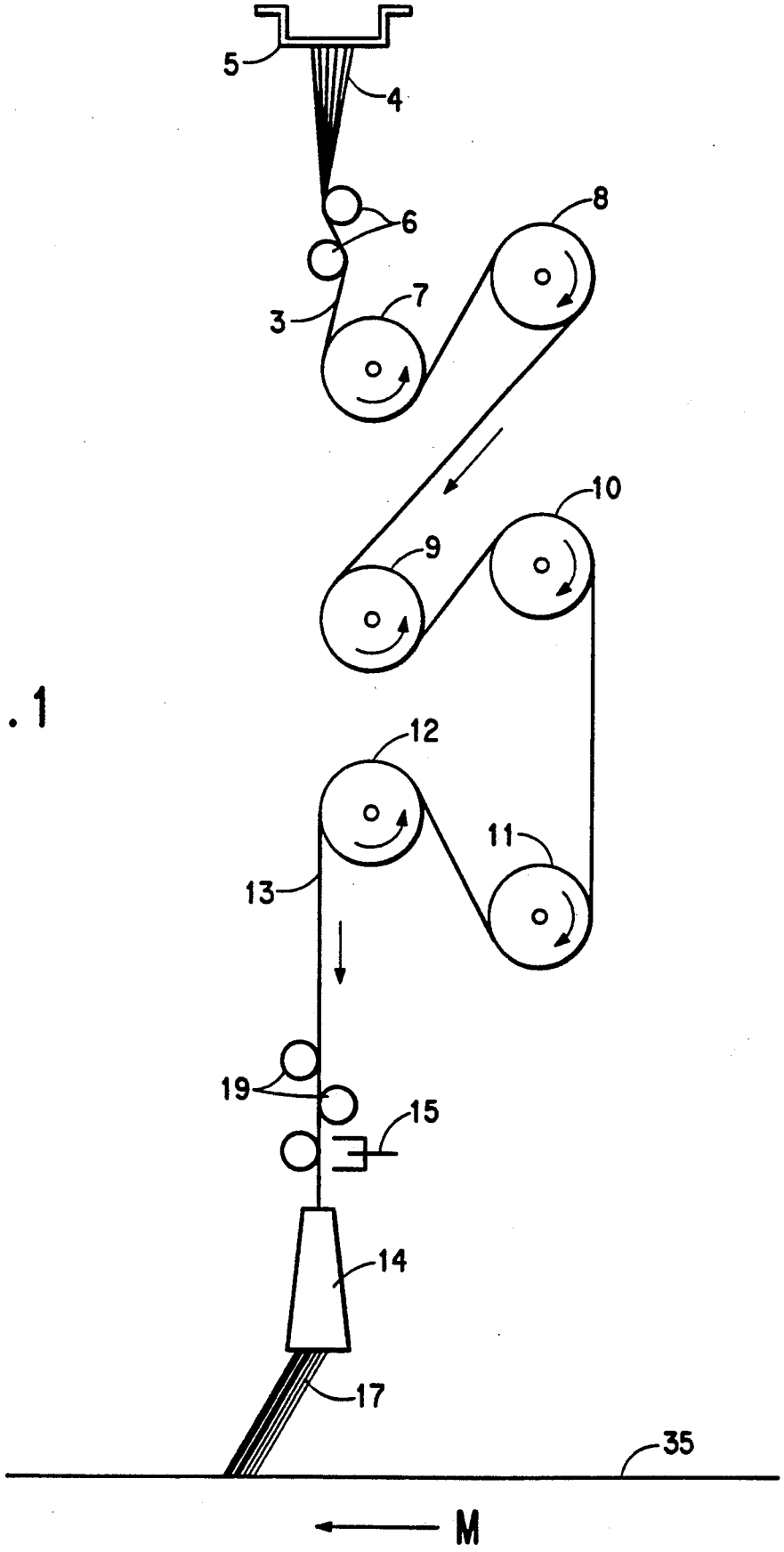
FIG. 1 is a schematic representation of an apparatus for drawing and depositing a ribbon of filaments on a moving belt.

As used herein, "draw ratio" means the ratio of the surface speed of the slowest roll (roll 7 in FIG. 1) to the surface speed of the fastest roll (roll 12 in FIG. 1).

As used herein, "lightly bonded" means that the nonwoven polyolefin sheet has been bonded sufficiently to provide sheet integrity for easy handling and debonding, but not enough to prevent debonding by means of, for example, tufting.

As used herein, "debonding" means a method of breaking bonds in a lightly bonded sheet to delaminate the sheet and allow fiber movement. Debonding provides more free fiber length in the nonwoven sheet. By way of example, and not by way of limitation, debonding can by accomplished by tufting with yarns or by needle punching the nonwoven sheet with smooth needles.

A general description of a process by which a continuous filament nonwoven fabric sheet (spunbonded sheet) can be prepared is provided in U.S. Pat. No. 3,563,838 (Edwards), the entire contents of which are incorporated by reference herein. According to Edwards, a bundle of polyolefin filaments are melt spun from a plurality of spinnerets. The filaments are then drawn at a low draw ratio (less than 2.0) according to the process and apparatus of U.S. Pat. No. 3,821,062 (Henderson), the entire contents of which are incorporated by reference herein. The relatively low draw ratio used allows the filaments to retain a very high elongation. The lower draw ratio provides adequate elongation levels but at the sacrifice of sheet tensile strength. Typically, prior art patents like Edwards teach and suggest that the draw ratio should be relatively high (i.e., greater than 2.0) in order to produce stronger filaments with decreased sheet elongation (i.e., less than 40%). The drawn filaments are deposited onto a moving collection device in both the machine (M or MD) and cross-machine (X or XD) directions to form a nonwoven fabric sheet. For purposes of the invention, the unit weight of the formed sheet is 100 to 150 g/m$^2$. According to Edwards, the fabric sheet is made having a specified filament directionality. Although it is preferred that the filament directionality be MXMX, various other combinations are also possible (e.g., MMXX and MXXM).

Referring now to FIG. 1, a ribbon of parallel filaments 3 is obtained by extruding filaments 4 from spinneret 5, quenching the filaments and passing them over guides 6. The ribbon of parallel filaments passes successively over rolls 7, 8, 9, 10, 11 and 12. The filaments travel at increasingly greater speed at each successive roll. Drawing is assisted by heating the filaments or portions thereof at roll 10. Rolls 7, 8 and 9 are smooth and unheated rolls and thus produce a very small amount of uniform draw on the filaments. Roll 10, however, is a fluted roll and has grooves running along its surface in the axial direction. Segments of the filaments which touch the hot surface of the roll between grooves are drawn additionally but those segments suspended over the grooved portions are not drawn additionally. The major portion of the drawing operation occurs between rolls 10 and 12.

The resulting filaments 13 have alternate highly oriented and less oriented segments along their length. The less oriented segments will have a lower melting point, and are generally referred to as "binder" segments. The ribbon of filaments 13 passes around convex rolls 19 which widen the ribbon and then the filaments are electrostatically charged upon passing across the target bar of a corona charging device 15 such as that described in U.S. Pat. No. 3,163,753 (DiSabato et al.), the entire contents of which are incorporated by reference herein. The ribbon of electrostatically charged continuous filaments is sucked into the orifice of slot jet 14 of the type shown in more detail in FIG. 2. Filaments are issued from slot jet exit 17 to deposition on a collection belt 35 moving in the indicated direction M (i.e., machine direction).

Figure 2:
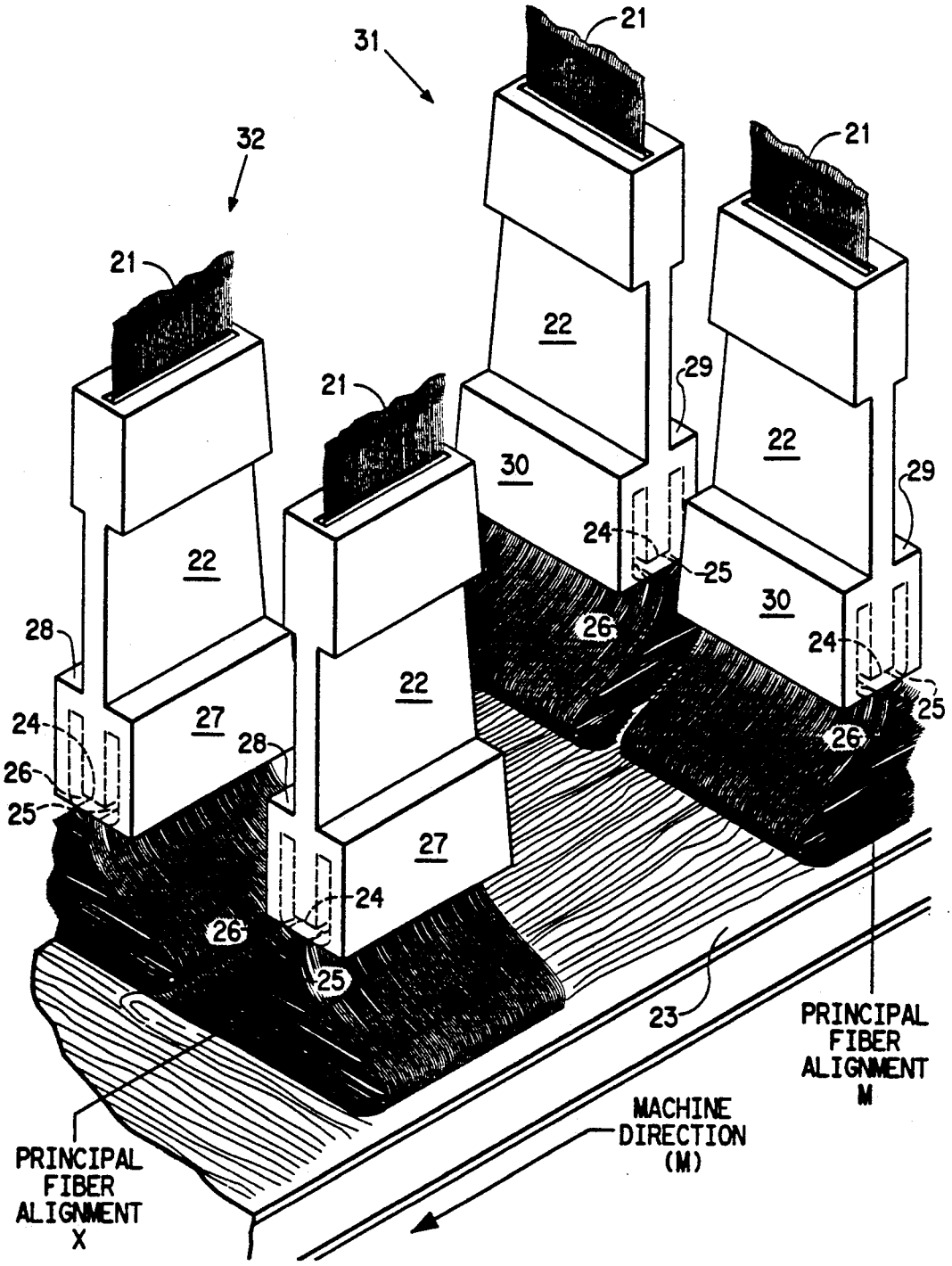
FIG. 2 is a perspective view of four air jet devices for deflecting filaments into layers each having a directionalized pattern.

In FIG. 2, ribbons of electrostatically charged continuous filaments 21 are forwarded by means of slot jet devices 22, toward a flexible pervious belt 23, covering a suction means (not shown). As the tension on the filaments is released at the exit 24, of the slot jet device 22, the filaments are deflected alternately by opposed air streams issuing from filament deflection gaps 25, 26, supplied alternately byplenums 27, 28, 29 and 30. Plenums 27, 28, 29 and 30 are connected through manifolds and transfer lines (not shown) to compressed air supplies governed by rotary valves having variable speed drives (not shown), that alternately provide air to the opposing plenums. In FIG. 2, a first bank or row 31 of two jets is used for machine direction (M) deflection and a second bank 32 of two jets is used for cross-machine direction (X) deflection.

For purposes of the invention, the nonwoven fabric sheet can be fabricated of any suitable polyolefin material. Preferably, the nonwoven sheet is fabricated of isotactic polypropylene filaments. As noted in Edwards, various filament deniers can be used. Preferably, the filaments are between 5 and 30 dtex and the unit weight of the nonwoven sheet before bonding is between 100 and 150 g/m$^2$.

Thereafter, the nonwoven sheet is lightly bonded (i.e., consolidated) by bonding means. Preferably, a steam bonder is used at a pressure of between 4.0 and 5.0 kg/cm$^2$. Typically, the sheet is then further bonded by passage through the nip of two heated, smooth-surfaced calendar rolls, followed by passage between a second nip formed by a heated patterning roll and a heated, smooth-surfaced back-up roll. Light bonding or consolidation is accomplished such that the sheet is rendered debondable yet so there is some degree of freedom for the filaments to slide and realign rather than being elongated in a rigid bonded form. The lightly bonded sheet is able to maintain sheet integrity and to provide sufficient debonding performance.

Preferably, in order to control sheet shrinkage, the lightly bonded sheet is heat stabilized using the process and apparatus of U.S. Pat. No. 4,232,434 (Pfister), the entire contents of which are incorporated by reference herein. Generally, heat stabilization takes place in a tenter frame by heating the lightly bonded nonwoven sheet at a temperature and for a period of time sufficient to relax the sheet in both the machine and cross directions. Heat stabilization results in controllable shrinkage in both of these directions. Heat stabilization also makes the nonwoven sheet more compatible with any secondary backing used (discussed below) in terms of shrinkage resulting from a bi-metal effect or curling.

A critical step in the inventive process is to debond the lightly bonded nonwoven sheet such that the elongation of the debonded sheet is increased to at least 40%, preferably 50% to 100%. If the elongation is too low, the nonwoven sheet is subject to tearing. If the elongation is too high, the nonwoven sheet is subject to grinning. "Grinning" is defined as increased spacing between tuft rows making the surface of the primary carpet backing visible through the yarn tufts on the face of the carpet. Elongation after debonding is a function of the draw ratio used to produce the original nonwoven sheet and the extent of debonding. If the draw ratio of the filaments is not below 2.0, then the elongation of the debonded sheet cannot be at least 40% for sheets having unit weights of between 100 and 150 g/m$^2$.

Debonding is typically accomplished by tufting the bonded sheet with tufting yarns or by needle punching the bonded sheet with smooth needles. Debonding preferably produces a sheet that has a thickness of between 2.5 and 3.5 times the thickness of the bonded nonwoven sheet before debonding. Conventional techniques for needle-punching and tufting are disclosed in U.S. Pat. No. 4,935,295 (Serafini) and U.S. Pat. No. 3,390,035 (Sands), respectively, the entire contents of which are incorporated by reference herein. Preferably, the tufting yarns are made of polypropylene, polyester or polyamide fibers (staple or bulked continuous filament (BCF) yarns). The tufting yarns can be predyed or the entire tufted nonwoven sheet can be dyed at this point using conventional dying techniques. Most frequently, the tufting style comprises cut pile velours in ⅛, 1/10 or 5/64 inch gage with a stitch density of between 40 and 70 stitches per 10 cm.

At this point, the debonded, nonwoven sheet can be molded into a desired shape by pressing the sheet between male and female portions of a mold. Details on the molding process are provided hereinafter. However, it is preferred that the debonded, nonwoven sheet be further treated in order to increase its overall strength, aesthetics and integrity.

Preferably before molding, the process further comprises the steps of applying a locking agent to the tufted sheet to lock the tufted yarns into the tufted sheet. The tufting industry typically applies a latex of synthetic or natural rubber to the backside of tufted carpets to provide this locking effect. Although the locking agent is usually a latex material, it can also be atactic polypropylene or ethylene vinyl acetate. The locking agent can be applied in any form so long as good tuft penetration is achieved during or following application. The locking agent is generally applied in a range between 20 and 200 g/m$^2$.

Thereafter, a backcoat is preferably applied onto the locking agent-coated, tufted, nonwoven sheet. Polyethylene is an example of a suitable backcoat material. Polypropylene is believed to also be a suitable backcoat material. As noted above for the locking agent, the backcoat may also be used in any form so long as it can be evenly applied in some manner and liquified/softened by heating or sintering. The backcoat should be applied in a range between 250 and 500 g/m$^2$. The backcoat provides rigidity to the sheet and helps it maintain its shape. A polyethylene backcoat that has been successfully used in the invention is ESCORENE" MP 650-35 polyethylene granules commercially available from Exxon Chemical Corporation of Houston, Tex.

Figure 4:
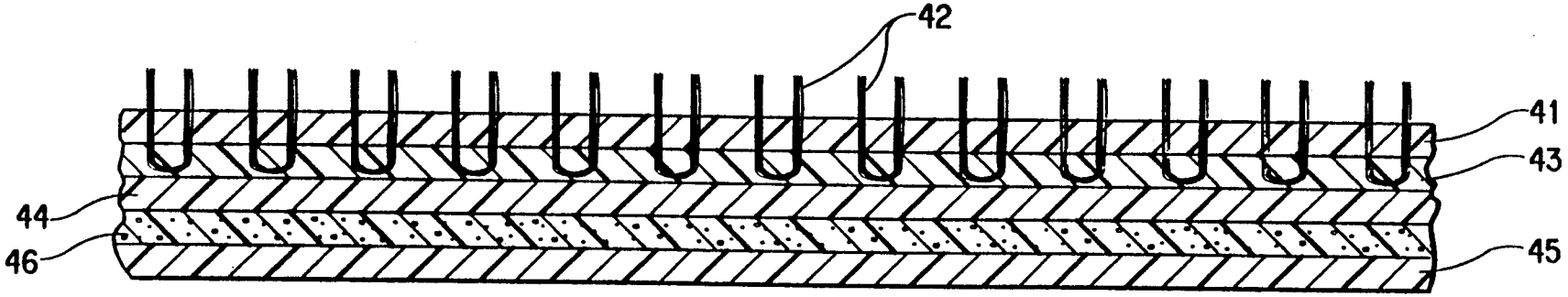
FIG. 4 is a cross-sectional view of a moldable, tufted automotive carpet made from the inventive nonwoven polyolefin sheet and having an optional heavy layer of soundproofing material.

Optionally, a very heavy layer of rubberized material can be laminated to the backcoated side of the nonwoven sheet to make a more rigid carpet. The layer is generally between 1 and 4 kg/m$^2$. The heavy layer provides the carpet with additional soundproofing and rigidity properties (See FIG. 4).

A secondary backing is then laminated to the backcoat to help prevent the sheet from sticking to the mold and to provide aesthetics and additional sheet strength. Additional strength is preferred because, as noted before, the low draw ratio used in the inventive process provides high elongation at the expense of sheet tensile strength. The secondary backing can comprise a bonded nonwoven sheet such as that commercially available from E. I. du Pont de Nemours S. A., Luxembourg under the trademark "Typar" spunbonded polypropylene. Style 3207 "Typar" is particularly preferred. The secondary backing should have sufficient elongation and strength to sustain the same elongation during molding as the debonded primary nonwoven sheet and to resist tearing. The residual shrinkage of the primary nonwoven sheet and the secondary backing should match to avoid a bi-metal effect (e.g., curling up or down) after demolding. The secondary backing should have a unit weight of between 30 and 75 g/m$^2$.

Figure 3:
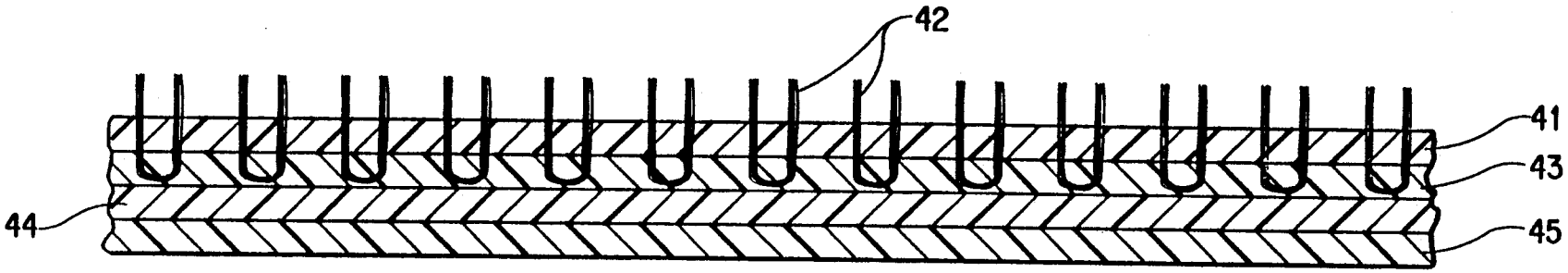
FIG. 3 is a cross-sectional view of a moldable, tufted automotive carpet made from the inventive nonwoven polyolefin sheet.

Referring now to FIG. 3, a cross-section is shown of a presently preferred automotive carpet according to the invention. The figure shows the carpet before it has been molded A nonwoven polyolefin sheet 41 is shown debonded by tufting yarns 42 across the entire expanse of the sheet. A latex locking agent 43 is applied to the backside (non-pile side) of sheet 41 in order to lock the tufting yarns 42 into sheet 41 A backcoat 44 is applied over the latex locking agent to add rigidity to the carpet. The backcoat 44 is preferably heated to sintering and a secondary backing 45 is laminated thereon. Optionally, a heavy layer of soundproofing material 46 (see FIG. 4) can be laminated in between the backcoat and the secondary backing to provide additional rigidity.

Molding typically takes place in a series of steps. Initially, the nonwoven sheet is precut to a desired length. Thereafter, the backside of the nonwoven sheet (secondary backing side) is heated in two stages to between 120 and 130 degrees C. and as a result the pile side of the nonwoven sheet normally reaches between 80 and 85 degrees C. Since molding has a greater effect on the cross-machine direction of the sheet than the machine direction, the sheet is then pinned along both lengths or also across both widths so as to hold the sheet in place during the molding process. Pinning also helps avoid creasing during molding. The nonwoven sheet is then molded at a mold station to the desired shape by compressing the nonwoven sheet between male and female portions of the mold. Molding typically takes place in 60 to 120 seconds. During molding, the sheet is elongated in the machine and cross-machine directions. Preferably, the mold is water cooled to speed up sheet demolding. Inside and outside cuts (by burning or water jet cutting) are then made to the demolded, nonwoven sheet so that it will fit over such things as gear boxes and parking brakes.

The resulting molded carpets are free of tears, creases, grinning and other defects experienced by the prior art Curling and carpet growth are not apparent, even after an extended period of time following demolding.

It should be noted that a major difference between the debonded primary sheet and the bonded secondary backing is that they differ in unit weight (100 to 150 g/m$^2$ versus 30 to 75 g/m$^2$). Thus, because of its unit weight and because the secondary backing reaches a higher temperature due to direct exposure to the heat source, it too will resist tearing during molding even though it may have an elongation below 40% at room temperature.

As noted previously, it is especially desirable to make 100% polyolefin (i.e., polypropylene) moldable, automotive carpets from debonded nonwoven sheets of the invention.

TEST METHODS

As used herein, the following test methods were used to determine various physical properties of the nonwoven sheets of the invention as well as those of the prior art.

Sheet Strip Tensile Strength (SST) is expressed in terms of kg. SST is measured in both the machine and cross-machine directions on a 5 cm width of the sheet according to Test Method DIN 53857-1.

Sheet Elongation (E) is expressed in terms of a percentage (%). It represents the elongation % at the maximum force in both the machine and cross-machine directions. E was also measured according to Test Method DIN 53857-1 for both tufted and untufted sheets.

Tufted Sheet Strip Tensile Strength (TST) is expressed in terms of kg. TST is measured in both the machine and cross-machine directions on a 5 cm width of the tufted/debonded sheet according to Test Method DIN 53857-1.

EXAMPLES

The following non-limiting examples are intended to illustrate the invention and set forth the best mode presently contemplated for carrying out the invention. These examples are provided by way of illustration and are not meant to limit the invention in any manner.

EXAMPLE 1

The general method of Henderson, U.S. Pat. No. 3,821,062, Example 1, was used to prepare the starting web of this example. However, the present preparation differed from the Henderson procedure in certain specific ways. For this example, isotactic polypropylene having a melt flow rate of 4.2 (as measured in accordance with ASTM D 1238, Procedure A, Condition L) was extruded at 248 degrees C. from multiple spinnerets, each having 910 orifices of 0.51 mm diameter. The fabric-forming machine had four rows of jets extending across the width of the collecting belt. Each row contained 17 spinneret positions, spaced about 30 cm apart. The second and fourth row filament streams were directed transverse (X or XD) to the direction of the movement of the collecting screen, while the first and third rows directed their fiber streams at an angle which was 90 degrees counterclockwise to the transverse direction (M or MD). Each spinneret extruded 54.5 kg/hr of filaments. The bundle of filaments from each spinneret was formed into a ribbon of parallel filaments and each ribbon was drawn by successively being passed over a series of six rolls. Each roll ran at a higher speed than the preceding one, with the major speed increase occurring between the fourth and fifth rolls (rolls 10 and 11 in FIG. I). The fourth of these rolls was "fluted" or "grooved", as described in U.S. Pat. No. 3,821,026, and was heated to 137 degrees C. The other rolls were not heated. The amount of undrawn, or binder, fiber in each row was 23, 32, 32 and 23%, respectively. Filaments from the first row were drawn 1.6X, the second row 1.9X, the third row 1.6X and the fourth row 1.7X. (The draw ratio is calculated by dividing the speed of the last roll (roll 12) by the speed of the first roll (roll 7). The speed by blocks of the first rolls differed slightly to accomodate uniformity. As a result, the drawn filaments had a dtex of 11±1.1 (dpf of 10±1)). The four filament ribbons were coalesced into a 120 g/m$^2$ web and collected on a belt moving at a speed of 101 meters/min. The web was then lightly consolidated in a steam bonder, operating at 4.5 kg/cm$^2$ steam pressure.

The consolidated web was further bonded by passage through the nip of two heated, smooth-surfaced rolls, followed by passage between a second nip formed by a heated patterning roll and a heated, smooth-surfaced back-up roll. The patterning roll consisted of 14.8 square tetrahedrons/sq cm, of 1.2 mm point size, having 0.6 mm deep engraving and 4 degrees engraving angle. The point rows were at 56 degrees to the MD, the row-to-row distance was 1.3 mm, and the bonded area was about 23%. The point edges were phased or rounded and polished to reduce fiber cutting. (It should be noted that pattern bonding is not essential to practicing the invention).

At this point the sheet exhibited a Sheet Strip Tensile (SST) value of 15 kg in the MD direction, and 10 kg in the XD direction, as measured on 5 cm strips using Test Method DIN 53875-1. The elongation was 24% in the MD and 26% in the XD, measured by the same test method.

The sheet was heat-stabilized using a recirculating air temperature of 163 degrees C., using the process and apparatus of Pfister, U.S. Pat. No. 4,232,434. The sheet temperature was about 20 degrees C. less than the air temperature (i.e., about 143 degrees C.).

The pattern-bonded, heat-stabilized sheet was tufted by conventional procedures, following the techniques disclosed in Sands, U.S. Pat. No. 3,390,035. The tufting yarn was an 11 dtex, spun nylon yarn commercially available from E. I. du Pont de Nemours and Company, Wilimington, Del. as Type 398A. The yarn was tufted at 1/10 gage (i.e., 10 tufts per inch of sheet width) with 52 stitches per 10 cm. Tuft height was 14 mm and the pile weight was 500 g/m$^2$.

Following tufting, the Tufted Strip Tensile (TST) was 27 kg and 13 kg in the MD and XD directions, respectively. The elongation was 67 and 55% in the MD and XD directions, respectively, again as measured by Test Method DIN 53875-1. As this indicates, it is typical that the TST is at least two times more in the MD direction than in the XD direction.

Following tufting, a backcoat was applied, consisting of 400 g polyethylene granules/m$^2$. A secondary backing was laminated to the polyolefin backcoat. The secondary backing consisted of "TYPAR" Style 3207 spunbonded polypropylene, a 68 g/sq yd product commercially available from E. I. du Pont de Nemours S. A. of Luxembourg.

EXAMPLE 2

As a comparative example, a commercial sample of Style 4409 "Typar" spunbonded polypropylene, (a standard commercial primary backing used for broadloom carpets which is 136 g/m$^2$, heat stabilized and point bonded) manufactured according to the teachings of U.S. Pat. No. 3,563,838 (Edwards), was tufted with tufting yarns and then treated with a latex, a backcoat and a secondary backing. The resulting tufted, nonwoven sheet was molded in a manner similar to that described in Example 1 above. The nonwoven sheet exhibited tearing during the molding process and significant curling after demolding. This indicated that the sheet had insufficient strength and elongation to sustain molding.

EXAMPLE 3

A sample was made generally according to Example 1, however, the sample had the properties set forth in Table I.

TABLE I

| | MD(SST) kg | XD(SST) kg | MD(E) % | XD(E) % |
|---|---|---|---|---|
| Untufted Nonwoven Sheet | 15.6 | 11.6 | 23.8 | 23.0 |
| | MD(TST) kg | XD(TST) kg | MD(E) % | XD(E) % |
| Tufted Sheet | 33.8 | 19.2 | 84.8 | 87.8 |
| Tufted Sheet w/ Backcoat | 55.0 | 38.1 | 56.0 | 77.3 |
| Tufted Sheet w/ Backcoat & Secondary Backing | 70.5 | 47.0 | 54.5 | 53.7 |
| Tufted Sheet w/ Backcoat & Secondary Backing & Heavy Soundproofing Layer | 71.6 | 58.3 | 65.7 | 77.3 |

Table I clearly demonstrates that the required elongation is achieved only after tufting (i.e., debonding). A substantial gain in sheet strength is also achieved with the addition of a backcoat and a secondary backing. The inventive carpet prior to molding has ample strength and elongation to sustain shallow or even deep shape molding.

EXAMPLE 4

In this example, a comparison was made between an inventive sample generally according to Example 1 and other commercially available primary carpet backings made form polyethylene terephthalate (PET). The results are set forth in Table II.

TABLE II

| Primary Backing | | | | |
|---|---|---|---|---|
| | Untufted Sheet | | | |
| | MD(SST) kg | XD(SST) kg | MD(E) % | XD(E) % |
| Inventive Nonwoven Sheet (PP) | 13.3 | 9.8 | 18.5 | 16.5 |
| (PET) Sheet Sample A* | 29.8 | 24.2 | 53.6 | 43.0 |
| (PET) Sheet Sample B** | 24.2 | 23.8 | 36.0 | 39.5 |
| | Tufted Sheet | | | |
| | MD(TST) kg | XD(TST) kg | MD(E) % | XD(E) % |
| Inventive Nonwoven Sheet (PP) | 29.5 | 12.2 | 68.6 | 71.4 |
| (PET) Sheet Sample A* | 27.5 | 17.7 | 44.7 | 47.7 |

*Sheet Sample A is a commercially available spunbonded polyester (PET) primary carpet backing from Akzo Chemical Company of the Netherlands under the tradename "Colbac".

**Sheet Sample B is another commercially available spunbonded polyester (PET) primary carpet backing from the German company Freudenberg under the tradename "Lutradur" Style 5012.

Table II shows that spunbonded polyester (PET) carpet backings have roughly the same strength and elongation in both untufted and tufted form. (Due to the nature of the polyester backing, the backing can be produced much differently than the inventive nonwoven polyolefin sheet). As Table II demonstrates, the situation is much different for spunbonded polypropylene (PP) primary carpet backings made by the inventive process where strength and elongation are dissimilar in tufted and untufted form.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A needled, nonwoven polyolefin sheet useful as a primary carpet backing in moldable carpets, the sheet comprising substantially continuous filaments of a polyolefin of 5 to 30 dtex, the filaments having directionality in both a machine and a cross-machine direction, the filaments having been drawn at a draw ratio less than 2.0, the sheet having been lightly bonded to an extent to achieve sheet integrity and subsequently needled to cause sheet delamination and filament movement to occur, said needling serving to increase the elongation capacity of the sheet, said needled sheet having a unit weight of 100 to 150 g/m$^2$, a sheet strip tensile strength of at least 10 kg in both the machine and cross-machine directions, and an elongation of at least 40% in both the machine and cross-machine directions.

2. The nonwoven sheet of claim 1 wherein the polyolefin comprises isotactic polypropylene.

3. The nonwoven sheet of claim 1 wherein the sheet is tufted with tufting yarn.

4. The nonwoven sheet of claim 3 wherein the tufting yarn is selected from the group consisting of polyamide, polypropylene and polyester.

5. The nonwoven sheet of claim 3 further comprising a locking agent to lock the tufting yarn into the nonwoven sheet.

6. The nonwoven sheet of claim 5 further comprising a secondary, bonded nonwoven sheet laminated to the nonwoven sheet.

7. The nonwoven sheet of claim 1 wherein the nonwoven sheet is molded into a desired shape.

8. The nonwoven sheet of claim 1 wherein the elongation is between 50% and 100% in both the machine and cross-machine directions.

9. The nonwoven sheet of claim 1 wherein the strip tensile strength is at least two times more in the machine direction as the strip tensile strength in the cross-machine direction.

10. A molded, automotive carpet made from the needled, nonwoven sheet of claim 1.

11. A 100% polyolefin molded, automotive carpet made from the needled, nonwoven sheet of claim 1.

* * * * *